US011420348B2

(12) United States Patent
Kim

(10) Patent No.: US 11,420,348 B2
(45) Date of Patent: Aug. 23, 2022

(54) ROTATABLE BODY HAIR CLIPPER

(71) Applicant: ROYAL METAL INDUSTRIAL CO., LTD, Bucheon-si (KR)

(72) Inventor: Gab-Soo Kim, Bucheon-si (KR)

(73) Assignee: ROYAL METAL INDUSTRIAL CO., LTD, Bucheon-si (KR)

( * ) Notice: Subject to any disclaimer, the term of this patent is extended or adjusted under 35 U.S.C. 154(b) by 0 days.

(21) Appl. No.: 17/170,433

(22) Filed: Feb. 8, 2021

(65) Prior Publication Data

US 2022/0219344 A1 Jul. 14, 2022

(30) Foreign Application Priority Data

Jan. 13, 2021 (KR) ..... 10-2021-0004729

(51) Int. Cl.
*B26B 19/14* (2006.01)
*B26B 19/38* (2006.01)
*B26B 19/16* (2006.01)

(52) U.S. Cl.
CPC ..... *B26B 19/148* (2013.01); *B26B 19/16* (2013.01); *B26B 19/3853* (2013.01)

(58) Field of Classification Search
CPC ..... B26B 19/148; B26B 19/14; B26B 19/141; B26B 19/143; B26B 19/145; B26B 19/146; B26B 19/3853
USPC ..... 30/43.4, 43.5, 43.6, 267, 29.5
See application file for complete search history.

(56) References Cited

U.S. PATENT DOCUMENTS 1,799,907 A * 4/1931 Kaufmann ..... B26B 19/148 30/29.5
2,686,965 A * 8/1954 Limpan ..... B26B 19/148 30/29.5
3,027,635 A * 4/1962 Frith ..... B26B 19/16 30/43.5

(Continued)

FOREIGN PATENT DOCUMENTS

DE 4130580 A1 * 3/1993 ..... B26B 19/148
GB 1185269 A * 3/1970 ..... B26B 19/148

OTHER PUBLICATIONS

DE-4130580-A1 English Translation; Mar. 1993; Seyfried Rico G.*

*Primary Examiner* — Laura M Lee
(74) *Attorney, Agent, or Firm* — Dennemeyer & Associates LLC; Steven M. Shape

(57) ABSTRACT

A rotatable body hair clipper is disclosed including a handle, a first cutting portion, a second cutting portion comprising a holding portion comprising a first tapered surface and a second tapered surface. The handle includes a handle main-body and a protrusion combination portion comprising a fastening portion comprising a first inclination surface and a second inclination surface. The protrusion combination portion comprises at least one slit such that when the second cutting portion is separated from the protrusion combination portion, the first tapered surface is brought into close contact with the second inclination surface and a part of the protrusion combination portion is elastically transformed inward in the radial direction when the second cutting portion is combined with the protrusion combination portion. The second tapered surface is brought into close contact with the first inclination surface and the part thereof returns to an original position thereof.

6 Claims, 9 Drawing Sheets

(56) References Cited

U.S. PATENT DOCUMENTS

| | | | | | |
|---|---|---|---|---|---|
| 3,106,775 | A * | 10/1963 | Lew | B26B 19/16 | 30/43.6 |
| 5,655,301 | A * | 8/1997 | Dickson | B26B 19/148 | 30/29.5 |
| 10,335,966 | B2 * | 7/2019 | Julemont | B26B 19/148 | |
| 2011/0067242 | A1 * | 3/2011 | Ogawa | B26B 19/148 | 30/29.5 |
| 2021/0237291 | A1 * | 8/2021 | Tran | B26B 19/148 | |

* cited by examiner

ROTATABLE BODY HAIR CLIPPER

CROSS REFERENCE TO RELATED APPLICATION

The present application claims priority to Korean Patent Application No. 10-2021-0004729, filed Jan. 13, 2021, the entire contents of which is incorporated herein for all purposes by this reference.

BACKGROUND OF THE INVENTION

Field of the Invention

The present disclosure relates to a body hair clipper that is simple and convenient to assemble and disassemble.

Description of the Related Art

Normally, there are a number of long and short nose hairs in the nose of a human body. These nose hairs serve to filter out foreign particles and the like to prevent the foreign particles from being introduced into the respiratory organs.

Recently, various types of nose hair clipping devices have been developed to clip nose hairs appearing outside of a nostril for sanitary reasons. Examples of this nose hair clipping device include nose hair scissors.

The nose hair scissors have the advantage of being simple to use. However, the nose hair scissors may cause a slight or serious wound to the nostril due to a structure thereof when in use because a position of the nose hairs in the nostril cannot be identified with the naked eye.

Therefore, to solve this problem, "motor-driven body hair clippers" have been recently developed. The "motor-driven body hair clippers" include an external head having a plurality of external cutting edges, an internal head having a plurality of internal cutting edges, and a holding screw holding the internal head and the external head together.

These motor-driven body hair clippers, each with a structure where the external head is motor-rotated with respect to the internal head, provide the advantage of being safe and convenient over the nose hair scissors when clipping the nose hair.

However, the motor-driven body hair clipper has a structure where the internal head and the external head are combined with each other by a fastening unit such as the holding screw, and thus are inconvenient to assembly and separate. There is a concern that the fastening unit will be lost frequently when assembling or disassembling the motor-driven body hair clipper. The entire motor-driven body hair clipper is required to be replaced when the fastening unit is lost.

The foregoing is intended merely to aid in the understanding of the background of the present disclosure, and is not intended to mean that the present disclosure falls within the purview of the related art that is already known to those skilled in the art.

DOCUMENT OF RELATED ART (Patent Document 1) Korean Utility Model Registration No. 20-0310081 (registered on Mar. 28, 2003)

SUMMARY OF THE INVENTION

An objective of the present disclosure is to provide a rotatable body hair clipper in which, using a forcible insertion method instead of another fastening unit, a first cutting portion and a second cutting portion are easy to combine with each other and the first cutting portion and the second cutting portion are easy to separate from each other after use.

Another objective of the present disclosure is to provide a rotatable body hair clipper having a structure for limiting rolling of the rotatable body hair clipper over a surface. With this structure, the risk of the rotatable body hair clipper being lost is remarkably reduced.

The present disclosure is not limited to these objectives. From the following description, other objectives can be clearly understood by a person of ordinary skill in the art to which the present disclosure pertains.

According to an aspect of the present disclosure, there is provided a rotatable body hair clipper including: a handle; a first cutting portion, arranged to be positioned in contact with an upper portion of the handle, and having a first cutting edge formed on an upper end thereof; and a second cutting portion into which the first cutting portion is inserted, of which an inner circumferential surface is thus brought into contact with the handle, and which has a second cutting edge formed on an upper end thereof, the second cutting edge being rotated with respect to the first cutting edge and thus a body hair being cut, wherein the handle includes: a handle main-body, with the first cutting portion being arranged to be positioned in contact with an upper portion of the handle main-body; and a protrusion combination portion, protruding from an upper end of the handle main-body along a direction of surrounding an outer circumferential surface of the first cutting portion, the protrusion combination portion being forcibly inserted into the second cutting portion in a removable manner to fasten the second cutting portion, thereby holding the second cutting portion in a rotatable manner.

According to first and second embodiments of the present disclosure, the advantage of easily and conveniently combining the first cutting portion and the second cutting portion with each other can be achieved using a forcible insertion method instead of another fastening unit. Furthermore, the advantage of easily and conveniently separating the first cutting portion and the second cutting from each other after use can be achieved.

In addition, according to the first and second embodiments of the present disclosure, the advantage of remarkably reducing the risk of the rotatable body hair clipper being lost can be achieved with the structure for limiting rolling of the rotatable body hair clipper over a surface.

The present disclosure is not limited to these advantages. From the following claims, other advantages can be clearly understood by a person of ordinary skill in the art to which the present disclosure pertains.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
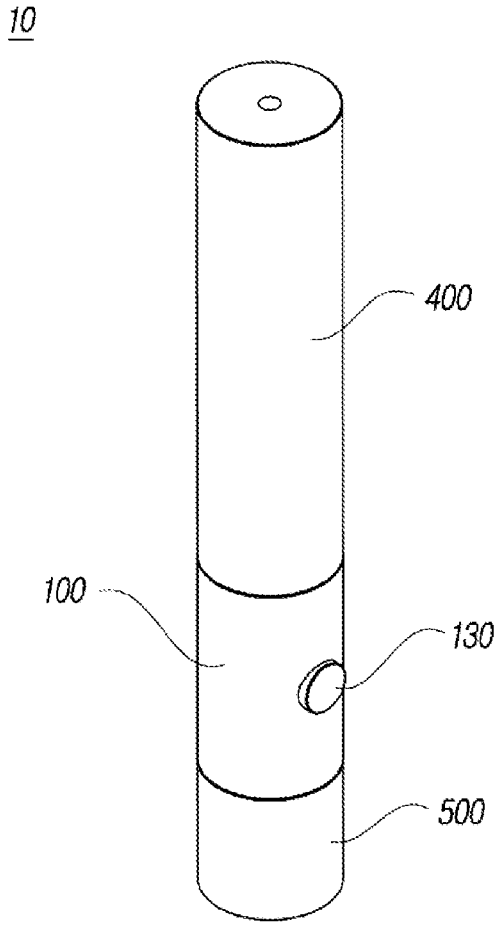
FIG. 1 is a perspective view illustrating a rotatable body hair clipper according to a first embodiment of the present disclosure.

Some embodiments of the present disclosure will be described in detail below with reference to the illustrative drawings. It should be noted that the same constituent elements, although illustrated in different drawings, are given the same reference character if possible throughout the drawings. In addition, specific descriptions of well-known configurations and functions associated with the present disclosure will be omitted when determined as making the nature and gist of the present disclosure unclear.

In addition, first, second, and so on, A, B, and so on, and (a), (b), and so on may be added to the terms used to describe constituent elements of the present disclosure. Such words or characters are used only to distinguish among the same constituent elements, and do not impose any limitation on the natures, the order, and the like of the same constituent elements. It should be understood that, when a constituent element is referred to as being "coupled to", "combined with", or "connected to" a different constituent element, such a constituent element may be directly coupled to, directly combined with, or directly connected to the different constituent element, or these two constituent elements may be "coupled to", "combined with", or "connected to" each other with a third constituent element interposed therebetween.

Figure 2:
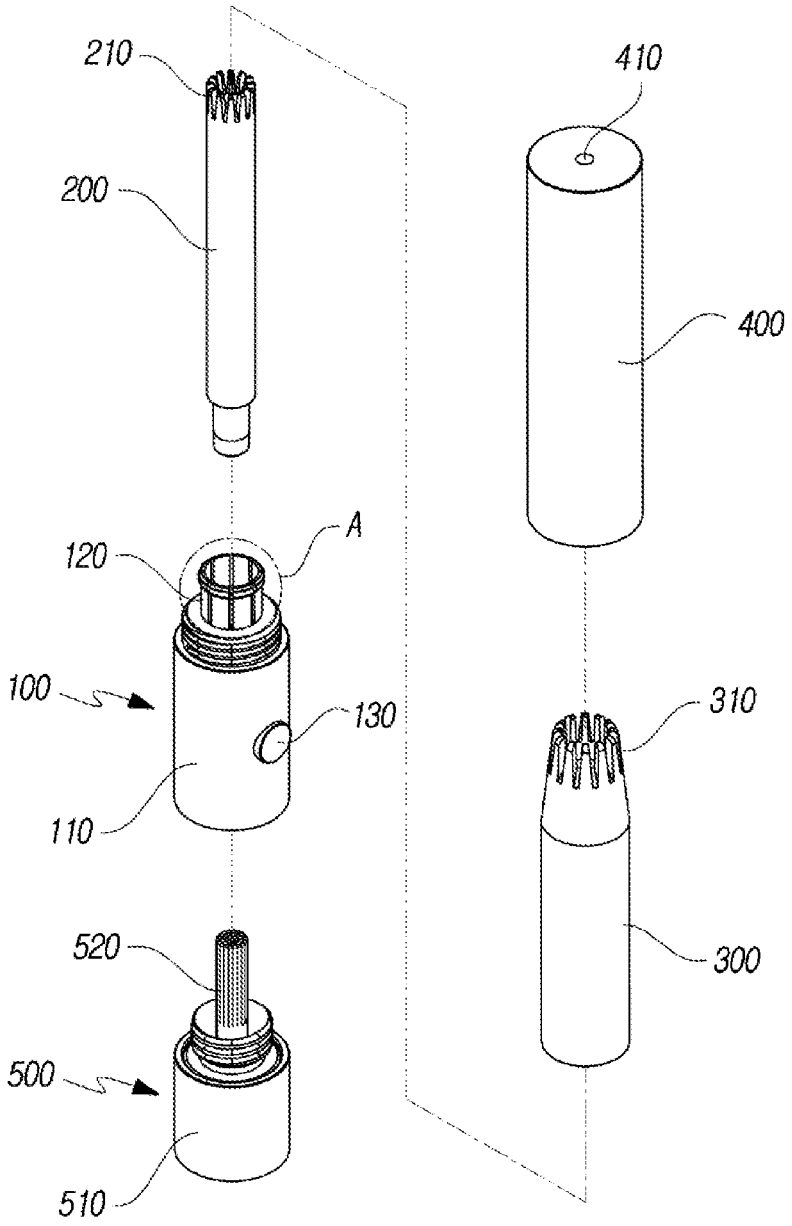
FIG. 2 is an exploded perspective view illustrating the rotatable body hair clipper according to the first embodiment of the present disclosure.
Figure 3:
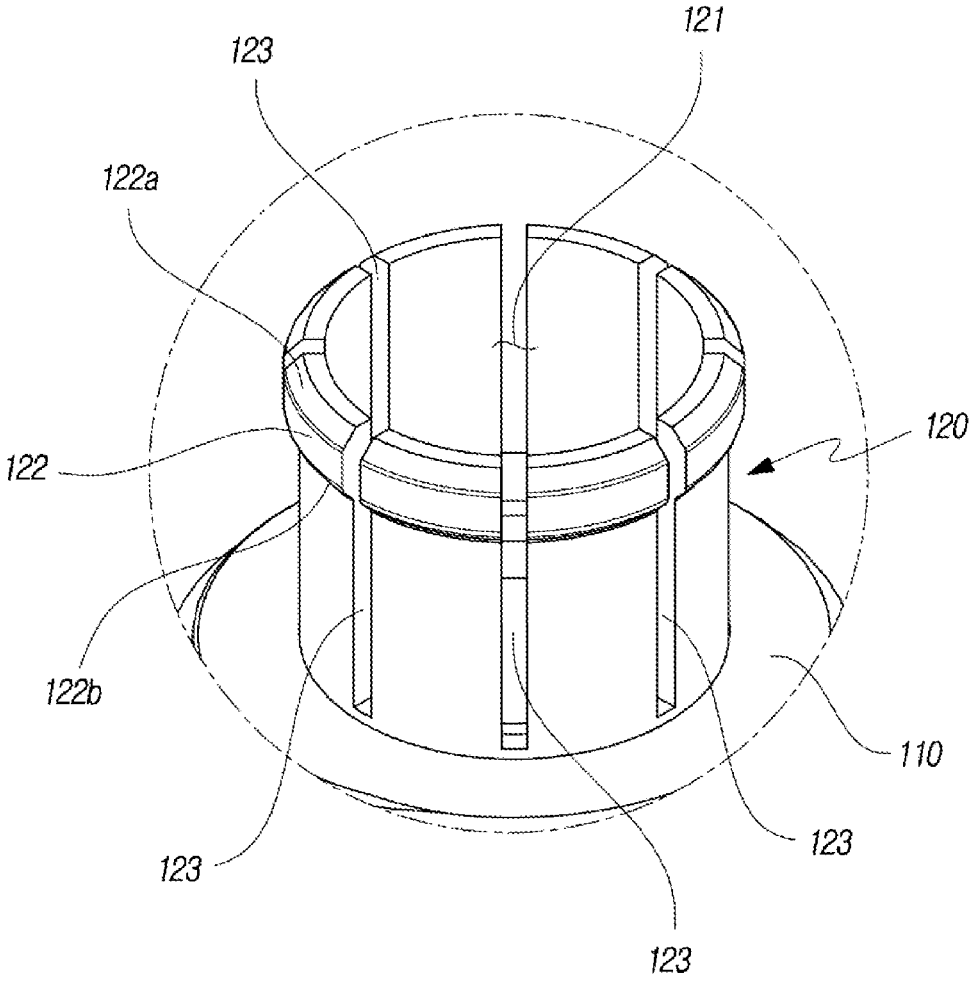
FIG. 3 is an enlarged view illustrating an A section in FIG. 2.
Figure 4:
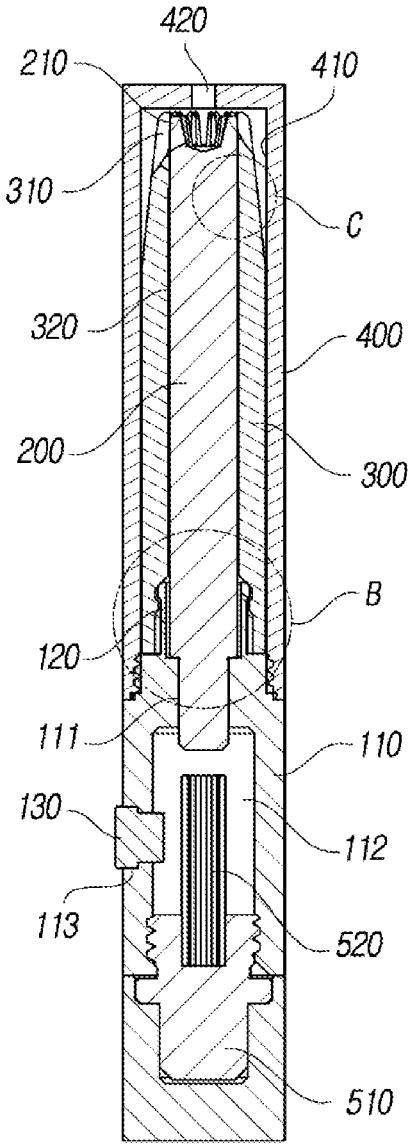
FIG. 4 is a vertical cross-sectional view illustrating an internal structure of the rotatable body hair clipper according to the first embodiment of the present disclosure.
Figure 5:
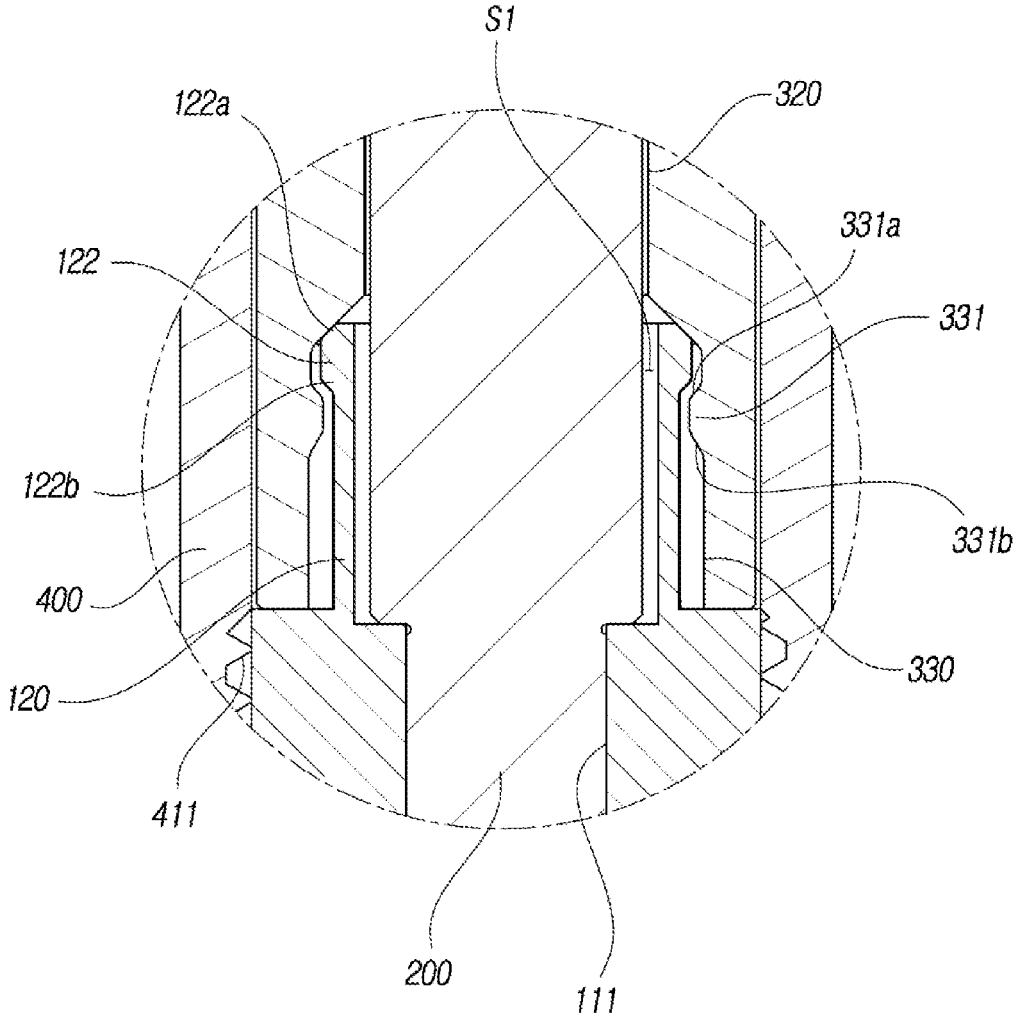
FIG. 5 is an enlarged view illustrating a B section in FIG. 4.
Figure 6:
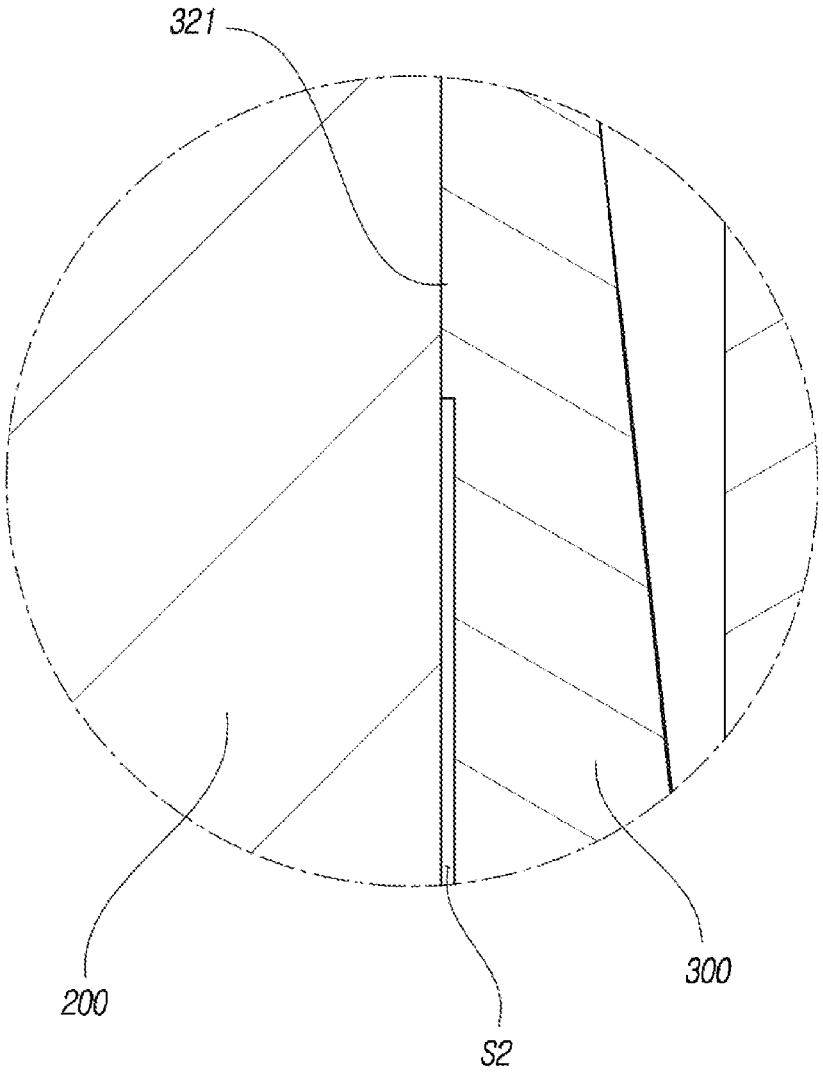
FIG. 6 is an enlarged view illustrating a C section in FIG. 4.
Figure 7:
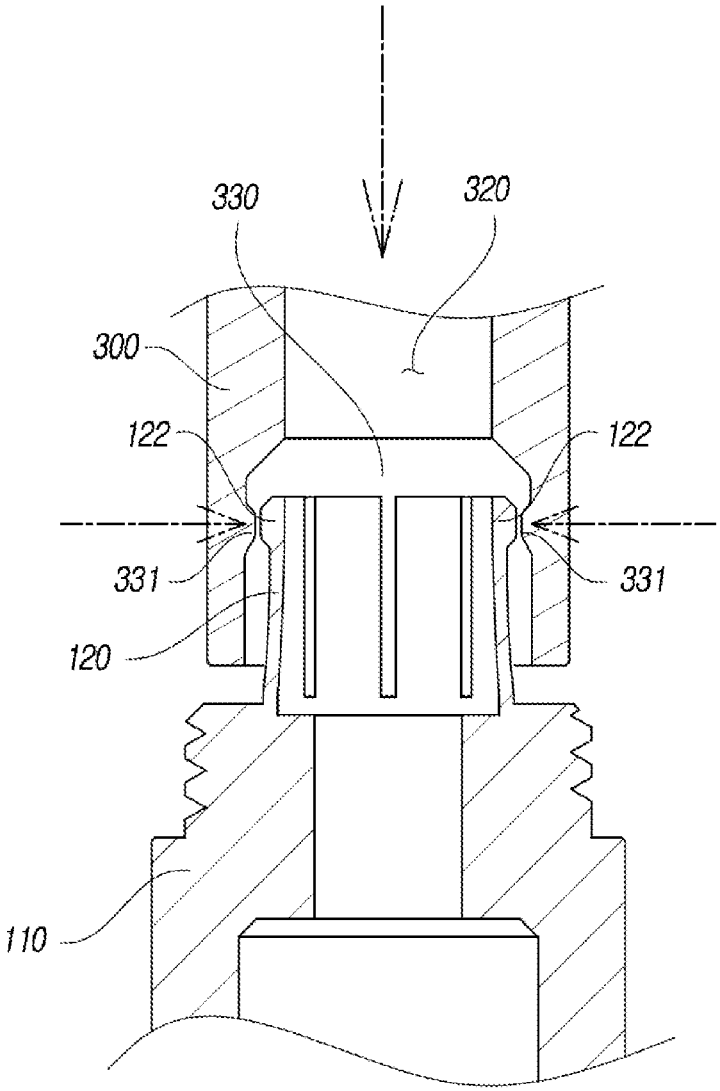
FIG. 7 is a view illustrating internal structures of a handle and a second cutting portion, which are combined with each other, according to the first embodiment of the present disclosure.
Figure 8:
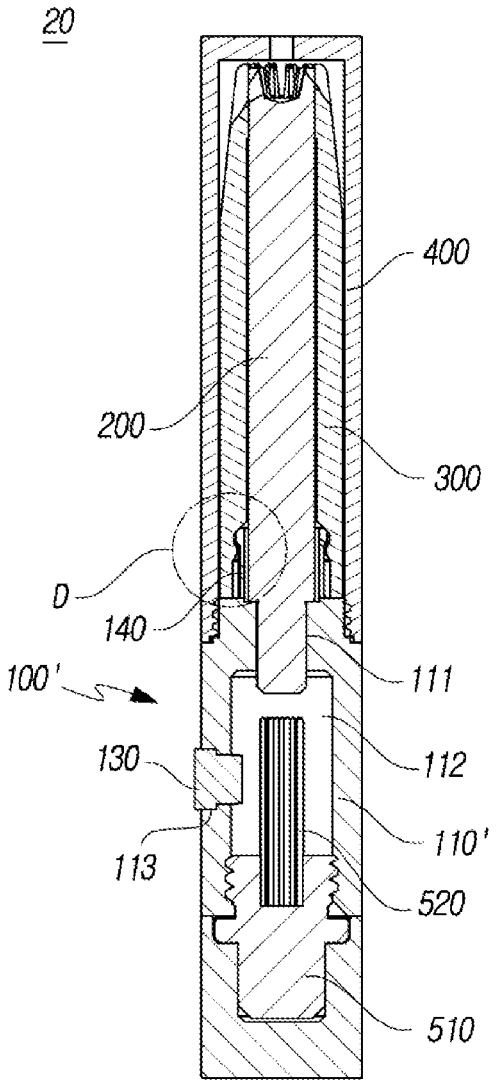
FIG. 8 is a view illustrating an internal structure of a rotatable body hair clipper according to a second embodiment of the present disclosure.
Figure 9:
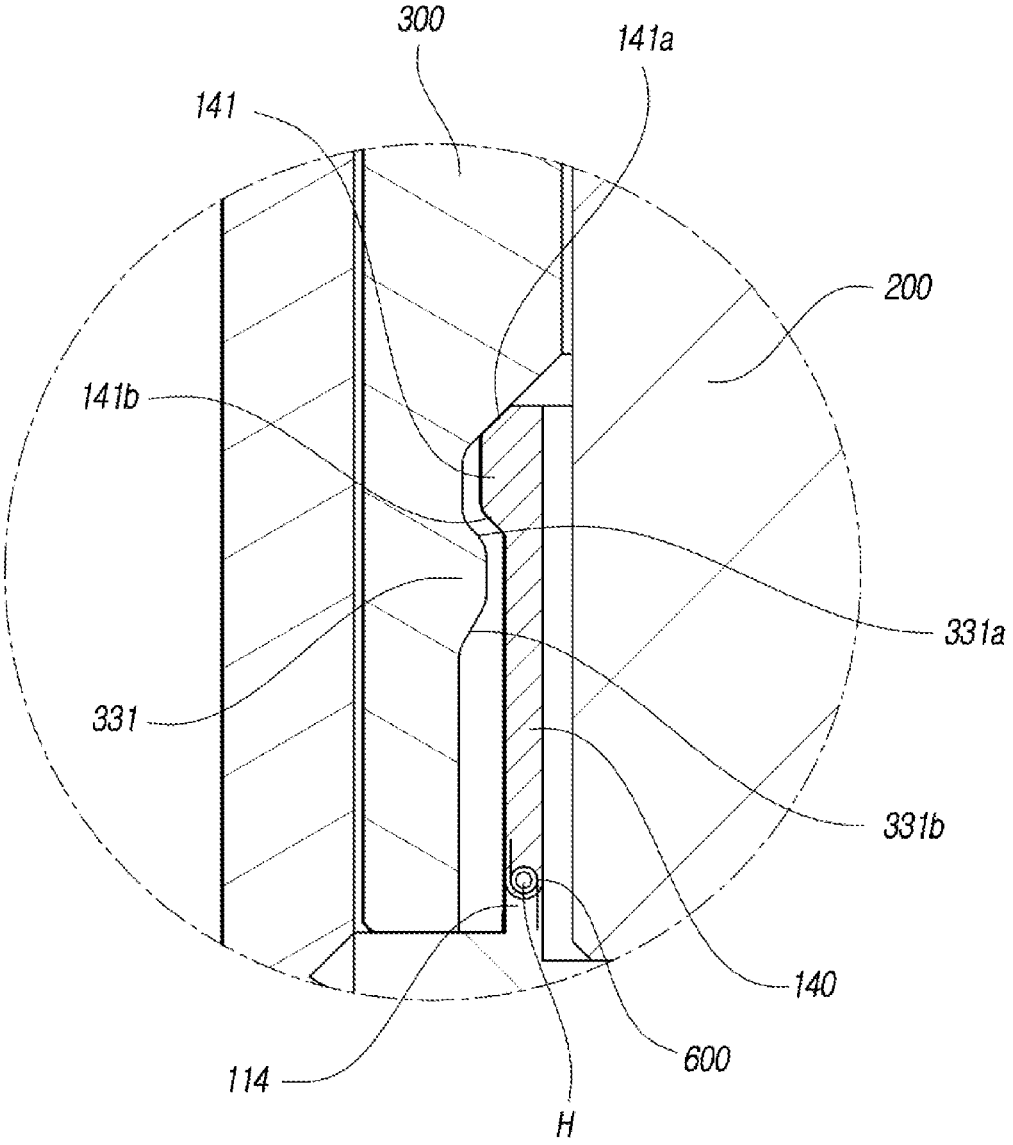
FIG. 9 is an enlarged view illustrating a D section in FIG. 8.

FIG. 1 is a perspective view illustrating a rotatable body hair clipper according to a first embodiment of the present disclosure. FIG. 2 is an exploded perspective view illustrating the rotatable body hair clipper according to the first embodiment of the present disclosure. FIG. 3 is an enlarged view illustrating an A section in FIG. 2. FIG. 4 is a vertical cross-sectional view illustrating an internal structure of the rotatable body hair clipper according to the first embodiment of the present disclosure. FIG. 5 is an enlarged view illustrating a B section in FIG. 4. FIG. 6 is an enlarged view illustrating a C section in FIG. 4. FIG. 7 is a view illustrating internal structures of a handle and a second cutting portion, which are combined with each other, according to the first embodiment of the present disclosure. FIG. 8 is a view illustrating an internal structure of a rotatable body hair clipper according to a second embodiment of the present disclosure. FIG. 9 is an enlarged view illustrating a D section in FIG. 8.

As illustrated in these figures, a rotatable body hair clipper 10 according to the first embodiment of the present disclosure includes a handle 100, a first cutting portion 200, and a second cutting portion 300. The first cutting portion 200 is arranged to be positioned in contact with an upper portion of the handle 100 and has a first cutting edge 210 formed on an upper end thereof. The first cutting portion 200 is inserted into the second cutting portion 300, and thus, an inner circumferential surface of the second cutting portion 300 is brought into contact with the handle 100. The second cutting portion 310 has a second cutting edge 310 formed on an upper end thereof, the second cutting edge 310 being rotated with respect to the first cutting edge 210 to cut a body hair. The handle 100 includes a handle main-body 110 and a protrusion combination portion 120. The first cutting portion 200 is arranged to be positioned in contact with an upper portion of the handle main-body 110. The protrusion combination portion 120 protrudes from an upper end of the handle main-body 110 along a direction of surrounding an outer circumferential surface of the first cutting portion 200. The protrusion combination portion 120 is forcibly inserted into the second cutting portion 300 in a removable manner to fasten the second cutting portion 300, thereby holding the second cutting portion 300 in a rotatable manner.

First, the first cutting portion 200 and the second cutting portion 300 are combined with the upper portion of the handle 100.

The handle 100 includes the handle main-body 110 with which the first cutting portion 200 is combined, and the protrusion combination portion 120 with which the second cutting portion 300 is separably combined.

The handle main-body 110 here is formed in an approximately cylindrical shape in such a manner as to facilitate a grip thereon. The first cutting portion 200 and the second cutting portion 300 are arranged to be positioned in contact with the upper portion of the handle main-body portion 110.

An insertion hole 111 into which the first cutting portion 200 is inserted is formed in an upper surface of the handle main-body 110. An accommodation hole 112 that communicates with the insertion hole 111 and accommodates at least one portion of a body-hair removal portion 500 is formed in a lower surface of the handle main-body 110.

In addition, a protrusion combination hole 113 is formed in an outer circumferential surface of the handle main-body 110. A rotation prevention protrusion 130 that will be described below is inserted into the protrusion combination hole 113.

The protrusion combination portion 120 is formed to protrude from an upper end of the handle main-body 110.

The protrusion combination portion 120 is formed to protrude along the direction of surrounding the outer circumferential surface of the first cutting portion 200. The protrusion combination portion 120 is pressed against the second cutting portion 300 in the outward direction from the first cutting portion 200, thereby holding the second cutting portion 300 in a rotatable manner.

That is, the protrusion combination portion 120 is formed in a cylindrical shape and thus has an accommodation space 121 inside. The first cutting portion 200 is arranged within the accommodation space 121.

The protrusion combination portion 120 is formed to be positioned a predetermined distance, that is, a gap S1, away from the first cutting portion 200. Thus, it is possible that, when combined with the second cutting portion 300, a part (an upper part) of the protrusion combination portion 120 is transformed inward in the radial direction.

In addition, the protrusion combination portion 120 is forcibly inserted into the second cutting portion 300 to fasten the second cutting portion 300. Thus, the second cutting portion 300 is easily attached to the protrusion combination portion 120 and is easily separated from the protrusion combination portion 120.

The protrusion combination portion 120 is described in more detail in terms of structure. A fastening portion 122, with which the inner circumferential surface of the second cutting portion 300 is combined, is formed in a convex or concave shape along an outer circumferential surface of the protrusion combination portion 120 in such a manner that the protrusion combination portion 120 is forcibly inserted into the second cutting portion 300 to fasten the second cutting portion 300.

As an example, the fastening portion 122 here, as illustrated in the drawings, is formed along the circumferential direction on an outer circumferential surface of an upper end portion of the protrusion combination portion 120 in a manner that protrudes therefrom.

In addition, inclination surfaces 122*a* and 122*b* are formed on upper and lower corners, respectively, of the fastening portion 122. Alternatively, one of the inclination surfaces 122*a* and 122*b* is formed on one of the upper and lower corners thereof. Thus, it is possible that the second cutting portion 300 is removably combined.

The drawings illustrate an example where the first inclination surface 122*a* and the second inclination surface 122*b* are formed on the upper and lower corners, respectively, of the fastening portion 122.

One slit 123 is formed in the protrusion combination portion 120 in such a manner, when the fastening portion 122 is brought into close contact with the second cutting portion 300, a part of the protrusion combination portion 120 is transformed inward in the radial direction and thus is combined with or separated from the second cutting portion 300.

The slit 123 is formed over a long distance in the length direction of the protrusion combination portion 120.

That is, when the fastening portion 122 is brought into close contact with the inner circumferential surface of the second cutting portion 300, a part of the protrusion combination portion 120 is elastically transformed inward in the radial direction and then elastically returns to an original position thereof. Thus, the second cutting portion 300 is combined with or separated from the protrusion combination portion 120.

A plurality of the slits 123 are formed to be positioned at equal distances from each other along a circumference of the protrusion combination portion 120.

In this manner, the inclination surfaces 122*a* and 122*b* are formed on the upper and lower corners, respectively, of the fastening portion 122 of the protrusion combination portion 120 according to the first embodiment of the present disclosure, and the plurality of the slits 123 are formed along the circumference of the protrusion combination portion 120. Thus, when the fastening portion 122 is brought into close contact with the inner circumferential surface of the second cutting portion 300, a part of the protrusion combination portion 120 is elastically transformed inward or outward in the radial direction. Accordingly, the protrusion combination portion 120 is forcibly inserted into the second cutting portion 300 without another separate combination unit, and thus the second cutting portion 300 is easy to combine with or separate from the protrusion combination portion 120.

The handle 100 according to the first embodiment of the present may further include the rotation prevention protrusion 130 protruding from the outer circumferential surface of the handle main-body 110 in such a manner as to limit rolling of the rotatable body hair clipper 10 along a surface.

The rotation prevention protrusion 130 is inserted into the protrusion combination hole 113 in the handle main-body 110, and thus at least one portion thereof protrudes from the outer circumferential surface of the handle main-body 110.

In this manner, the handle 100 according to the first embodiment of the present disclosure includes the rotation prevention protrusion 130 limiting the rolling of the rotatable body hair clipper 10 along a flat surface. Thus, the risk of losing the rotatable body hair clipper 10 can be remarkably reduced.

The first cutting portion 200 according to the first embodiment of the present disclosure is inserted into the insertion hole 111 in the handle main-body 110, thereby being held.

The first cutting portion 200 positioned inside the second cutting portion 300 supports the second cutting portion 300 in a rotatable manner.

In addition, the first cutting portion 200 has the first cutting edge 210 formed on the upper end thereof.

The plurality of the first cutting edges 210 are formed to be positioned at equal distances from each other along the outer circumferential surface of the first cutting portion 200.

The more the end of each of the first cutting edges 210 here is approached, the smaller width each of the first cutting edges 210 is formed to have. Thus, an inside corner edge portion of each of the first cutting edges 210 is obliquely formed.

The oblique formation of the corner edge portion of each of the first cutting edges 210 provides the advantage of improving the performance in cutting the body hair.

An internal hole 320 is formed over a long distance in the length direction inside the second cutting portion 300 according to the first embodiment of the present disclosure. The first cutting portion 200 is inserted into the internal hole 320 in such a manner that the second cutting portion 300 is rotatable.

In addition, the protrusion combination portion 120 is forcibly inserted into the second cutting portion 300, and thus the second cutting portion 300 is combined with the handle 100.

More specifically, the protrusion combination portion 120 is forcibly inserted into the second cutting portion 300, and thus the inner circumferential surface of the second cutting portion 300 is brought into contact with the protrusion combination portion 120 in a rotatable manner. Accordingly, the second cutting portion 300 is held in a rotatable manner by the protrusion combination portion 120.

The second cutting portion 300 is described in more detail in terms of structure. A rotation combination portion 330 is formed along a lower end portion of the second cutting portion 300, in a concave shape in the radial direction outward from the internal hole 320. The rotation combination portion 330 squarely faces the outer circumferential surface of the protrusion combination portion 120.

A holding portion 331, with which the fastening portion 122 is engaged, is formed in a convex or concave shape along an inner circumferential surface of the second cutting portion 300 in such a manner that the second cutting portion 300 is fastened to the protrusion combination portion 120 and then is held in a rotatable manner.

The holding portion 331 here is formed in a convex or concave shape along the inner circumferential surface of the second cutting portion 300.

The drawings illustrate an example where the fastening portion 122 is formed to protrude from an outer circumferential surface of the protrusion combination portion 120 and where the holding portion 331 is formed to protrude in the radial direction inward from the inner circumferential surface of the second cutting portion 300.

A first tapered surface 331*a* is formed on an upper corner of the holding portion 331, and a second tapered surface 331*b* is formed on a lower corner thereof. Thus, it is possible that the protrusion combination portion 120 is forcibly inserted into the second cutting portion 300 and that the second cutting portion 300 is thus attached to or separated from the protrusion combination portion 120.

When the second cutting portion 300 is separated from the protrusion combination portion 120, the first tapered surface 331*a* here is brought into close contact with the second inclination surface 122*b* of the fastening portion 122.

At this point, a part (an upper part) of the protrusion combination portion 120 is elastically transformed inward in the radial direction.

In addition, when the second cutting portion 300 is combined with the protrusion combination portion 120, the second tapered surface 331*b* is brought into close contact with the first inclination surface 122*a* of the fastening portion 122.

At this point, a part (an upper part) of the protrusion combination portion 120 is elastically transformed inward in the radial direction, and then returns to an original position thereof. Thus, the rotation combination portion 330 squarely faces the outer circumferential surface of the protrusion combination portion 120.

According to the first embodiment of the present disclosure, in this manner, the formation of the holding portion 331 on the inner circumferential surface of the second cutting portion 300 and the formation of the tapered surface 331*a* and 331*b* on the upper and lower corners, respectively, of the holding portion 331 makes it possible for the handle 100 to hold the second cutting portion 300 in a rotatable manner when the second cutting portion 300 is combined with the protrusion combination portion 120 and makes it possible to forcibly insert the protrusion combination portion 120 into the second cutting portion 300. This structure provides the advantage of easily attaching the second cutting portion 300 to the handle 100 and easily separating the second cutting portion 300 from the handle 100.

A support surface 321 is formed on the second cutting portion 300. The support surface 321 protrudes in the radial direction inward from the internal hole 320 and is supported in a rotatable manner on the outer circumferential surface of the first cutting portion 200. Thus, it is possible that a portion of the inner circumferential surface of the second cutting portion 300 having the internal hole 320 inside is positioned a predetermined distance away from the first cutting portion 200.

According to the first embodiment of the present disclosure, in this manner, since the support surface 321 is supported on the first cutting portion 200, a gap S2 is formed between the first cutting portion 200 and the second cutting portion 300, thereby reducing an area in which the first cutting portion 200 and the second cutting portion 300 are brought into close contact with each other. Accordingly, the reduction in the area can reduce friction that occurs when rotating the second cutting portion 300.

The second cutting edge 310 is formed on an upper end of the second cutting portion 300. The second cutting edge 310 is rotated with respect to the first cutting edge 210 and thus the body hair is cut.

A plurality of the second cutting edge 310 are formed to be positioned at equal distances from each other along an outer circumferential surface of the second cutting portion 300.

That is, the second cutting portion 300 is inserted into a user's nose and then is rotated with respect to the first cutting portion 200, thereby cutting the user's nose hair (body hair).

The more the end of each of the second cutting edges 310 is approached, the smaller width each of the second cutting edges 310 is formed to have. Thus, an outside corner edge portion of each of the second cutting edges 310 is obliquely formed.

The oblique formation of the corner edge portion of each of the second cutting edges 310 provides the advantage of improving the performance in cutting the body hair.

The rotatable body hair clipper 10 according to the first embodiment of the present disclosure may further include a cover portion 400 into which the second cutting portion 300 is inserted and which is removably combined with the handle main-body 110 in such a manner as to selectively open and close the first cutting portion 200 and the second cutting portion 300.

An accommodation hole 410 is formed over a long distance in the length direction inside the cover 400 in which the first cutting portion 200 and the second cutting portion 300 are accommodated.

The cover portion 400 is combined with the handle main-body 110 by employing a groove-protrusion fitting structure or a screw-engagement structure.

As an example, as illustrated in the drawings, a screw thread 411 is formed in an inner circumferential surface of the cover portion 400, and thus the handle main-body 110 is screwed into the cover portion 400 in such a manner that the outer circumferential surface of the handle main-body 110 is brought into contact with the inner circumferential surface of the cover portion 400.

In addition, an air discharge hole 420 is formed in the cover portion 400. When the second cutting portion 300 is inserted into the cover portion 400, inside air is discharged to the outside of the cover portion 400 through the air discharge hole.

The air discharge hole 420 here is formed to be pierced through the top of the cover portion 400 in such a manner as to communicate with the accommodation hole 410.

According to the present disclosure, the formation of the air discharge hole 420 piercing through the top of the cover portion 400 and the formation of the screw hold 411 on the inner circumferential surface thereof make the second cutting portion 300 easy to insert into the cover portion 400. Thus, the second cutting portion 300 is combined with the handle 100 easily and conveniently.

The rotatable body hair clipper 10 according to the first embodiment of the present disclosure may further include the body-hair removal portion 500 for removing the body hair remaining on the first cutting portion 200 and the second cutting portion 300. The body-hair removal portion 500 is combined with a lower portion of the handle main-body 110.

The body-hair removal portion 500 includes a removal main-body 510 and a removal brush 520. The removal main-body 510 is removably combined with the lower portion of the handle main-body 110. The removal brush 520 is provided on an upper end of the removal main-body 510 and is used to remove the body hair remaining on the first cutting portion 200 and the second cutting portion 300.

After using the rotatable body hair clipper 10 with the body-hair removal portion 500 according to the first embodiment of the present disclosure, the first cutting portion 200 and the second cutting portion 300 are separated from each other, and then the body hair remaining on the outsides of the first cutting edge 210 and the second cutting edge 310 is easy to remove with the removal brush 520.

FIGS. 8 and 9 are views each illustrating an internal structure of a rotatable body hair clipper 20 according to a second embodiment of the present disclosure.

The rotatable body hair clipper 20 according to the second embodiment, which is illustrated in FIGS. 8 and 9, has the same constituent elements as the rotatable body hair clipper 10 according to the first embodiment, which is described above, except that the rotatable body hair clipper 20 includes a plurality of protrusion combination pieces 140 instead of the protrusion combination portion 120. Each of the constituent elements of the rotatable body hair clipper 20 has the same shape and function as each of the constituent elements of the rotatable body hair clipper 10.

The rotatable body hair clipper 20 according to the second embodiment of the present disclosure includes the plurality of protrusion combination pieces 140 on a handle 100'.

More specifically, the handle 100' according to the second embodiment of the present disclosure includes a handle main-body 110' and the plurality of protrusion combination pieces 140. The first cutting portion 200 is arranged to be positioned in contact with an upper portion of the handle main-body 110'. The plurality of protrusion combination pieces 140 are arranged along a direction of surrounding an outer circumferential surface of the first cutting portion 200 and are combined in a rotatable manner with an upper end of the handle main-body 110'. The plurality of protrusion combination pieces 140 are forcibly inserted into the second cutting portion 300 in a removable manner to fasten the second cutting portion 300, thereby holding the second cutting portion 300 in a rotatable manner.

A plurality of combination protrusions 114 are formed to be positioned at equal distances from each other along the direction of surrounding the outer circumferential surface of the first cutting portion 200 on an upper surface of the hand main-body 110'.

The plurality of protrusion combination pieces 140 are combined in a rotatable manner with the combination protrusions 114, respectively.

Lower end portions of the plurality of protrusion combination pieces 140 are hinge-combined with the combination protrusions 114, respectively. Thus, the plurality of protrusion combination pieces 140 are rotatable about a hinge shaft H, outward and inward in the radial direction of the handle main-body 110'.

That is, since the lower end portions of the plurality of protrusion combination pieces 140 are combined in a rotatable manner with the combination protrusions 114, respectively, it is possible that the plurality of protrusion combination pieces 140 are forcibly inserted into the second cutting portion 300, thereby holding the second cutting portion 300 in a rotatable manner.

A fastening protrusion 141 is formed on each of the protrusion combination pieces 140. The fastening protrusion 141 is combined with the inner circumferential surface of the second cutting portion 300. Thus, it is possible that the plurality of protrusion combination pieces 140 are forcibly inserted into the second cutting portion 300, thereby fastening the second cutting portion 300.

The plurality of fastening protrusions 141 here are formed to protrude toward the inner circumferential surface of the second cutting portion 300 from upper portions, respectively, of the protrusion combination pieces 140. When the second cutting portion 300 is combined with the plurality of protrusion combination pieces 140, the plurality of fastening protrusions 141 are engaged with the holding portion 331, and thus the second cutting portion 300 is held in a rotatable manner.

A first inclination surface 141*a* and a second inclination surface 141*b* are formed on upper and lower corners, respectively, of the fastening protrusions 141. Thus, it is possible that the second cutting portion 300 is removably combined.

When the plurality of protrusion combination pieces 140 are forcibly inserted into the second cutting portion 300, the first inclination surface 141*a* is brought into close contact with the second tapered surface 331*b* of the holding portion 331.

At this point, the protrusion combination piece 140 is rotated inward in the radial direction of the handle main-body 110' about the hinge shaft H. Then, the protrusion combination piece 140 returns to an original position thereof and thus is combined with the second cutting portion 300.

In addition, when the second cutting portion 300 is separated from the plurality of protrusion combination pieces 140, the second inclination surface 141*b* is brought into close contact with the first tapered surface 331*a* of the holding portion 331.

At this point, the protrusion combination piece 140 is rotated inward in the radial direction of the handle main-body 110' about the hinge shaft H and then is separated from the second cutting portion 300.

The rotatable body hair clipper 20 according to the second embodiment of the present disclosure may further include an elastic member 600 combined with the hinge shaft H. A first end of the elastic member 600 is supported on the protrusion piece 140, and a second end thereof is supported on the combination protrusion 114. Accordingly, the elastic member 600 provides an elastic force for rotating the protrusion combination 140 about the hinge shaft H in the direction of bringing the protrusion combination piece 140 into close contact with the second cutting portion 300.

With the elastic force, the elastic member 600 rotates the protrusion combination piece 140 about the hinge shaft H. Thus, it is possible that the plurality of protrusion combination pieces 140 are forcibly inserted into the second cutting portion 300 and that the fastening protrusion 141 and the holding portion 331 are then engaged with each other.

Examples of the elastic member 600 include a torsion spring.

According to the second embodiment of the present disclosure, in this manner, the plurality of protrusion combination pieces 140 are combined in a rotatable manner with the upper end of the handle main-body 110', and the elastic member 600 providing the elastic force for engaging the fastening protrusion 141 and the holding portion 331 with each other is provided. Thus, the handle main-body 100' and the second cutting portion 300 are easy to combine and separate from each other.

As described above, according to the first and second embodiments of the present disclosure, there is provided an advantage in that the first cutting portion 200 and the second cutting portion 300 are easy and convenient to combine with each other using the forcible insertion method instead of another separate fastening unit and in that the first cutting portion 200 and the second cutting portion 300 are easy and convenient to separate from each other.

In addition, according to the first and second embodiments of the present disclosure, there is provided another advantage in that the risk of losing rotatable body hair clipper is remarkably reduced by employing the structure where the rotation prevention protrusion 130 is included to limit the rolling of the rotatable body hair clipper along a surface.

Although two or more of the constituent elements that constitute the rotatable body hair clipper according to each of the first and second embodiments of the present disclosure are described as being combined into a single constituent element to perform a function or as being combined with each other to perform a function, the present disclosure is not necessarily limited to this embodiment. That is, two or more of the constituent elements may be selectively combined with each other to perform a function within the range of the objectives of the present disclosure.

In addition, unless otherwise particularly specified, the terms "include", "constitute", and "have", which are used throughout the specification, mean that the named constituent element is essential, and therefore should be interpreted as including additional constituent elements without precluding additional constituent elements. Unless otherwise particularly defined, all terms including technical or scientific terms have the same meaning as are normally understood by a person of ordinary skill in the art to which the present disclosure pertains. The ordinary terms as defined in dictionaries should be interpreted as having the same meaning in context as those in the art, and, unless otherwise particularly defined in the present specification, should not be construed as having an excessively implied meaning or a purely literal meaning.

The technical idea of the present disclosure is described only for illustrative purpose. Therefore, it is apparent to a person of ordinary skill in the art to which the present disclosure pertains that various modifications and alterations are possibly made to the present disclosure without departing the nature and gist of the present disclosure.

Therefore, the embodiments disclosed in the present specification are provided for describing, not limiting, the technical idea of the present disclosure, and do not impose any limitation on the scope of the technical idea of the present disclosure. Accordingly, the scope of the present disclosure should be defined by the following claims. All equivalent technical ideas should be interpreted as falling within the scope of the present disclosure.

What is claimed is:

1. A rotatable body hair clipper comprising:

a handle;

a first cutting portion, held to be positioned in contact with an upper portion of the handle, and having a first cutting edge formed on an upper end thereof; and a second cutting portion into which the first cutting portion is inserted, of which an inner circumferential surface is thus brought into contact with the handle, and which has a second cutting edge formed on an upper end thereof, the second cutting edge being rotated with respect to the first cutting edge to cut a body hair, wherein the handle comprises:

a handle main-body, with the first cutting portion being held to be positioned in contact with an upper portion of the handle main-body; and a protrusion combination portion, protruding from an upper end of the handle main-body along an outer circumferential surface of the first cutting portion, the protrusion combination portion being forcibly inserted into the second cutting portion in a removable manner to fasten the second cutting portion, thereby holding the second cutting portion in a rotatable manner, wherein the protrusion combination portion comprises a fastening portion, with which the inner circumferential surface of the second cutting portion is combined, the fastening portion being formed in a convex shape along an outer circumferential surface of the protrusion combination portion in such a manner that the protrusion combination portion is forcibly inserted into the second cutting portion to fasten the second cutting portion, wherein the fastening portion comprises a first inclination surface and a second inclination surface that are formed on upper and lower corners of the fastening portion respectively in such a manner that the second cutting portion is removably combinable, wherein the second cutting portion comprises a holding portion, with which the fastening portion is engaged, the holding portion being formed in a convex shape along the inner circumferential surface of the second cutting portion in such a manner that the second cutting portion is fastened to the protrusion combination portion and then is held in a rotatable manner, wherein the holding portion comprises a first tapered surface and a second tapered surface that are formed on upper and lower corners of the holding portion respectively in such a manner that the protrusion combination portion is forcibly inserted into the second cutting portion and that the second cutting portion is thus attached to or separated from the protrusion combination portion, wherein the protrusion combination portion comprises at least one slit that is formed in the protrusion combination portion in such a manner that when the second cutting portion is separated from the protrusion combination portion, the first tapered surface is brought into close contact with the second inclination surface and a part of the protrusion combination portion is elastically transformed inward in the radial direction and when the second cutting portion is combined with the protrusion combination portion, the second tapered surface is brought into close contact with the first inclination surface and the part of the protrusion combination portion is elastically transformed inward in the radial direction, and returns to an original outward position thereof.

2. The rotatable body hair clipper of claim 1, wherein the slit comprises a plurality of slits that are formed to be positioned at equal distances from each other along a circumference of the protrusion combination portion.

3. The rotatable body hair clipper of claim 1, wherein the handle comprises:

a rotation prevention protrusion protruding from an outer circumferential surface of the handle main-body in such a manner as to limit rolling of the rotatable body hair clipper along a surface.

4. The rotatable body hair clipper of claim 1, further comprising:

a cover portion into which the second cutting portion is inserted and which is removably combined with the handle main-body in such a manner as to selectively open and close the first cutting portion and the second cutting portion.

5. The rotatable body hair clipper of claim 4, wherein the cover portion is combined with the handle main-body by employing a groove-protrusion fitting structure or a screw-engagement structure.

6. The rotatable body hair clipper of claim 4, wherein the cover portion comprises an air discharge hole, through which inside air is discharged to an outside of the cover portion when the second cutting portion is inserted into the cover portion.

* * * * *